US006086051A

United States Patent [19]

Wiebe et al.

[11] Patent Number: 6,086,051

[45] Date of Patent: Jul. 11, 2000

[54] PORTABLE VERSATILE STRUCTURE

[76] Inventors: John S. Wiebe, 3104 Babich Street, Abbotsford, British Columbia, Canada, V2S 5W5; Dave A. Unger, 34376 Redwood Avenue, Abbotsford, British Columbia, Canada, V2S 2T7

[21] Appl. No.: 09/015,095

[22] Filed: Jan. 29, 1998

[51] Int. Cl.[7] ..... E04H 17/16

[52] U.S. Cl. ..... 256/25; 256/24; 256/65; 256/73; 256/31; 49/254

[58] Field of Search ..... 256/24, 25, 26, 256/59, 65, 73, 19, 31; 52/239, 592.6, 586.1; 472/92, 90; 49/57, 55, 254

[56] References Cited

U.S. PATENT DOCUMENTS

| | | | |
|---|---|---|---|
| 462,985 | 11/1891 | Miller | 256/73 |
| 582,427 | 5/1897 | Keller | 256/73 |
| 2,822,041 | 2/1958 | Blankenship | 49/254 |
| 2,825,433 | 3/1958 | Robinson | 49/254 |
| 4,457,117 | 7/1984 | Leither et al. | 52/239 X |
| 4,516,619 | 5/1985 | Hasbrouck | 52/239 X |
| 4,561,229 | 12/1985 | Gartung | 52/239 |
| 5,544,870 | 8/1996 | Kelley et al. | 256/25 |
| 5,758,466 | 6/1998 | Tucker | 52/586.1 X |
| 5,797,218 | 8/1998 | Holland | 49/55 |
| 5,820,470 | 10/1998 | Saunders | 256/25 |

*Primary Examiner*—Lynne H. Browne
*Assistant Examiner*—John R. Cottingham

[57] ABSTRACT

A portable structure is provided including a plurality of wall sections each having a front face, a rear face, and a periphery formed therebetween. The periphery is defined by a horizontally oriented linear top and bottom edge and a pair of vertically oriented linear side edges. Each top edge has an elongated slot formed therein along an entire length thereof and in communication with the side edges. Further included is a plurality of interconnects adapted to be removably situated within the slots of adjacent wall sections to maintain the lateral relationship thereof. The interconnects include planar interconnects and angled interconnects.

15 Claims, 6 Drawing Sheets

PORTABLE VERSATILE STRUCTURE

BACKGROUND OF THE INVENTION

1. Field of the Invention

The present invention relates to portable peripheral structures and more particularly pertains to a new portable versatile structure for affording a portable rink, playpen, or the like.

2. Description of the Prior Art

The use of portable peripheral structures is known in the prior art. More specifically, portable peripheral structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable peripheral structures include U.S. Pat. No. 4,815,301; U.S. Pat. No. 3,986,342; U.S. Pat. No. 3,883,120; U.S. Pat. No. 4,497,483; U.S. Pat. No. 4,271,622; and U.S. Pat. No. Des. 332,148.

In these respects, the portable versatile structure according to the present invention substantially departs from the conventional concepts and designs of the prior art, and in so doing provides an apparatus primarily developed for the purpose of affording a portable rink, playpen, or the like.

SUMMARY OF THE INVENTION

In view of the foregoing disadvantages inherent in the known types of portable peripheral structures now present in the prior art, the present invention provides a new portable versatile structure construction wherein the same can be utilized for affording a portable rink, playpen, or the like.

The general purpose of the present invention, which will be described subsequently in greater detail, is to provide a new portable versatile structure apparatus and method which has many of the advantages of the portable peripheral structures mentioned heretofore and many novel features that result in a new portable versatile structure which is not anticipated, rendered obvious, suggested, or even implied by any of the prior art portable peripheral structures, either alone or in any combination thereof.

To attain this, the present invention generally comprises a plurality of wall sections each having a front face, a rear face, and a periphery formed therebetween. As shown in FIG. 2, such periphery is defined by a horizontally oriented linear top and bottom edge and a pair of vertically oriented linear side edges. Each top and bottom edge has an elongated slot formed therein along an entire length thereof and in communication with the side edges. With continuing reference to FIG. 2 and attention to FIG. 3, a pair of rectangular cut outs are formed in the top and bottom edges of the periphery at opposite ends thereof. Lastly, a pair of vertically oriented square bores are provided each with a square horizontal cross-section. The square bores are formed in the top edge of the periphery adjacent to the cut outs. Next provided is a door assembly including a square opening formed in at least one of the wall sections. The square opening defines a bottom edge spacedly situated in parallel relationship with the bottom edge of the corresponding wall section. Further defined is a pair of side edges which extend to the top edge. As shown in FIG. 12, one of the side edges of the square opening has a flange extending along a length thereof and in coplanar relationship with an outer surface of the corresponding wall section. In addition, a tab is mounted to the side edge to which the flange is coupled in coplanar relationship with an inner surface of the corresponding wall section. The door assembly further includes a square planar door pivotally coupled along a side edge thereof to one of the side edges of the square opening. The door assembly is further adapted to allow a slight vertical adjustment thereof. FIG. 11 depicts a recessed handle formed in an inner surface of the door. A square cut out is formed in one of the side edges opposite the pivotal coupling. Mounted within the square cut out is a downwardly extending member. A recess is formed in an outer surface of the door along one of the side edges thereof. By this structure, the door is adapted to pivot between a closed orientation wherein the flange of the corresponding wall section resides within the recess of the door and the downwardly extending member is positioned between the tab and flange of the corresponding wall section for locking purposes. The door is further adapted to have an open orientation upon the lifting and pivoting thereof. Also included is a plurality of lateral interconnects each including a plate with a pair of outwardly extending tabs mounted on each end thereof. As such, the lateral plates of the lateral interconnects may be removable mounted within the elongated slot of a pair of wall sections. In such orientation, the outwardly extending members remain within the square bores to maintain the relative orientation of the wall sections. FIGS. 2–7 and 9 show an anchor assembly including a pair of spherical members mounted to a central extent of at least two of the lateral interconnects and extending outwardly therefrom. Note FIGS. 5 & 6. A frame is provided including a horizontally oriented member with a first end and a second end. Associated therewith is a telescoping angled member with a first end and a second end. As shown in FIG. 9, the first ends of the horizontally oriented member and the angled member are hingably coupled. The second ends of the members of the frame are equipped with a recess for snappily receiving the spherical members of the interconnects of the anchor assembly. FIG. 7 depicts a hollow anchor with a lid for allowing an interior space thereof to be filled with sand. A bottom face of the anchor has a rectangular slot for receiving the horizontal member of the anchor assembly. During use, the anchor maintains the frame level on a receiving surface to ensure that the wall sections remain vertically oriented. As shown in FIGS. 13–16, the lateral interconnects include a plurality of angled interconnects which are bisected by an elbow for allowing adjacent wall sections be coupled such that planes in which they reside intersect at various angles. An outer surface of the elbow of each angled interconnect has an eyelet for the removable coupling of rope for support purposes. Finally, a plurality of longitudinal interconnects each include a planar plate with a pair of oblong cutouts formed therein at a central extent thereof. The longitudinal interconnects are adapted to be removably inserted within slots associated with the top edge of a first wall section and the bottom edge of a second wall such that they are stacked vertically.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable versatile structure apparatus and method which has many of the advantages of the portable peripheral structures mentioned heretofore and many novel features that result in a new portable versatile structure which is not anticipated, rendered obvious, suggested, or even implied by any of the prior art portable rinks, either alone or in any combination thereof.

It is another object of the present invention to provide a new portable versatile structure which may be easily and efficiently manufactured and marketed.

It is a further object of the present invention to provide a new portable versatile structure which is of a durable and reliable construction.

An even further object of the present invention is to provide a new portable versatile structure which is susceptible of a low cost of manufacture with regard to both materials and labor, and which accordingly is then susceptible of low prices of sale to the consuming public, thereby making such portable versatile structure economically available to the buying public.

Still yet another object of the present invention is to provide a new portable versatile structure which provides in the apparatuses and methods of the prior art some of the advantages thereof, while simultaneously overcoming some of the disadvantages normally associated therewith.

Still another object of the present invention is to provide a new portable versatile structure for affording a portable rink, playpen, or the like.

Even still another object of the present invention is to provide a new portable versatile structure that includes a plurality of wall sections each having a front face, a rear face, and a periphery formed therebetween. The periphery is defined by a horizontally oriented linear top and bottom edge and a pair of vertically oriented linear side edges. Each top edge has an elongated slot formed therein along an entire length thereof and in communication with the side edges. Further included is a plurality of interconnects adapted to be removably situated within the slots of adjacent wall sections to maintain the lateral relationship thereof. The interconnects include planar interconnects and angled interconnects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
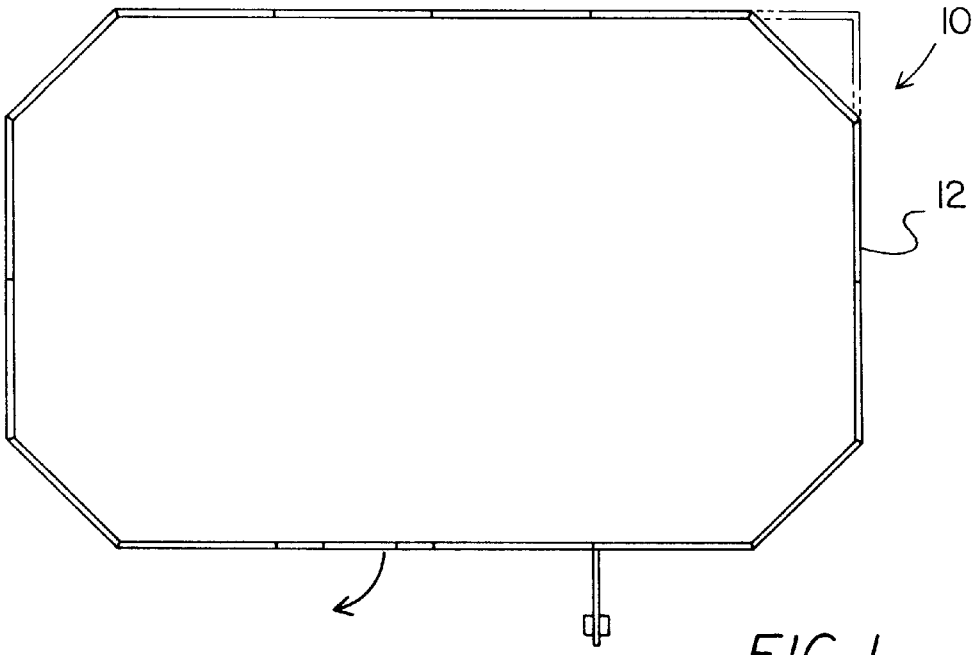
FIG. 1 is a top view of a new portable versatile structure according to the present invention.

With reference now to the drawings, and in particular to FIGS. 1 through 16 thereof, a new portable versatile structure embodying the principles and concepts of the present invention and generally designated by the reference numeral 10 will be described.

Figure 2:
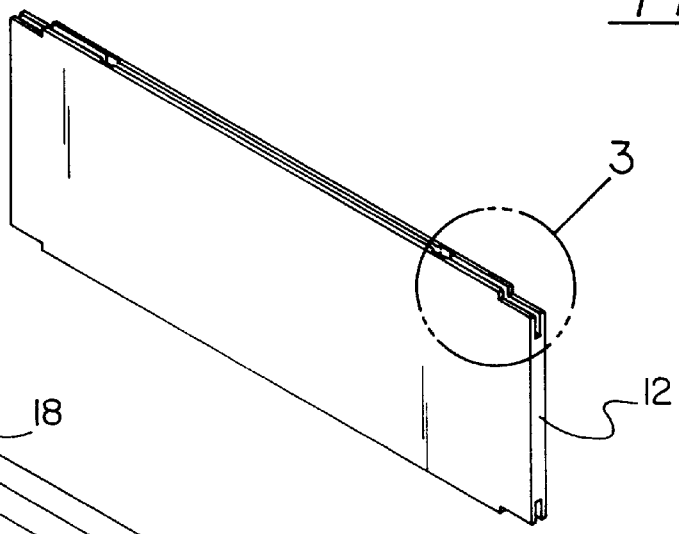
FIG. 2 is a perspective view of one of the wall sections of the present invention.
Figure 3:
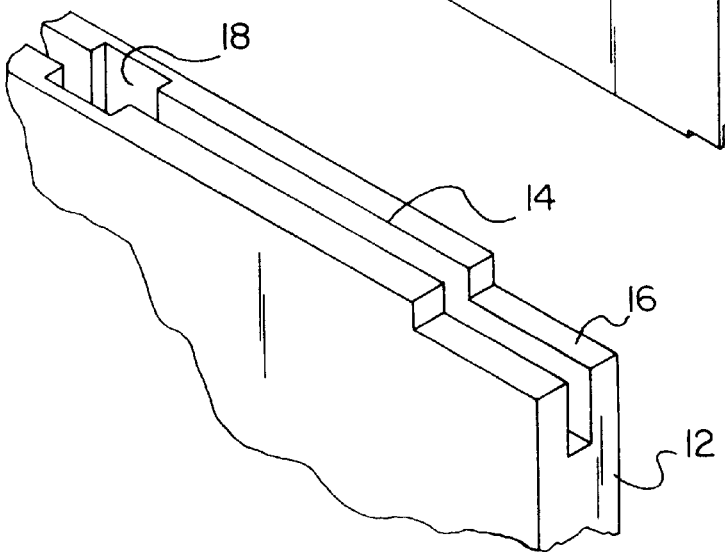
FIG. 3 is a close up view of the slot, cutouts and bore of one of the wall sections of the present invention.
Figure 4:
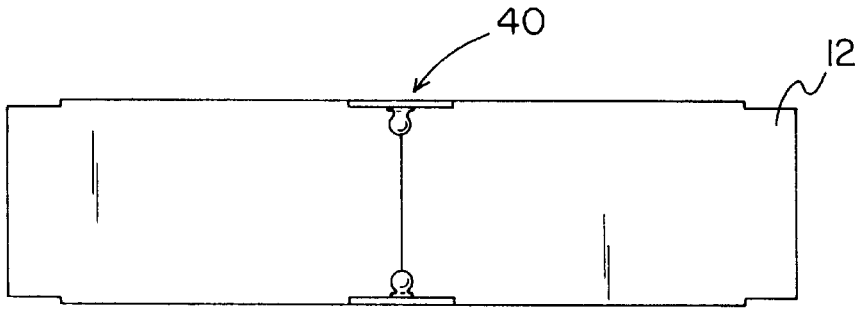
FIG. 4 is a side view of various components of the anchor assembly of the present invention.
Figure 5:
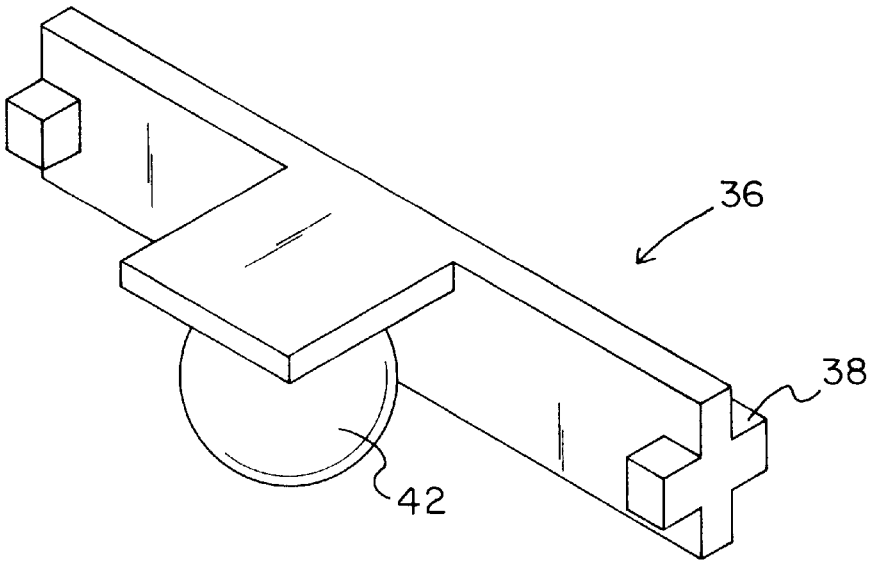
FIGS. 5 & 6 are perspective illustrations of the components of the anchor assembly shown in FIG. 4.
Figure 6:
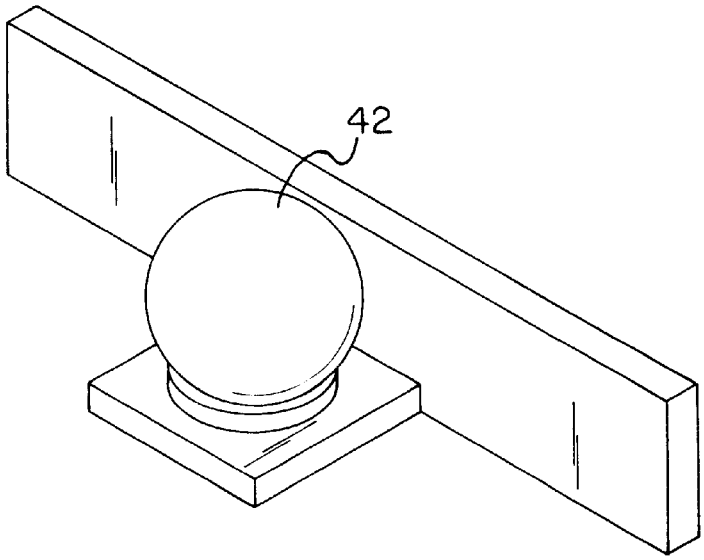

The present invention, as designated as numeral 10 includes a plurality of wall sections 12 each having a front face, a rear face, and a periphery formed therebetween. As shown in FIG. 2, such periphery is defined by a horizontally oriented linear top and bottom edge and a pair of vertically oriented linear side edges. Each top and bottom edge has an elongated slot 14 formed therein along an entire length thereof and in communication with the side edges. With continuing reference to FIG. 2 and attention to FIG. 3, a pair of rectangular cut outs 16 are formed in the top and bottom edges of the periphery at opposite ends thereof. Lastly, a pair of vertically oriented square bores 18 are provided each with a square horizontal cross-section. The square bores are formed in the top and bottom edges of the periphery adjacent to the cut outs.

Figure 12:
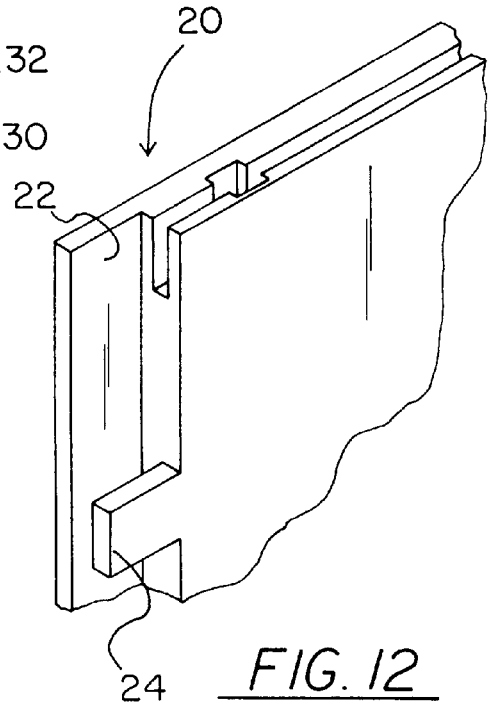
Figure 13:
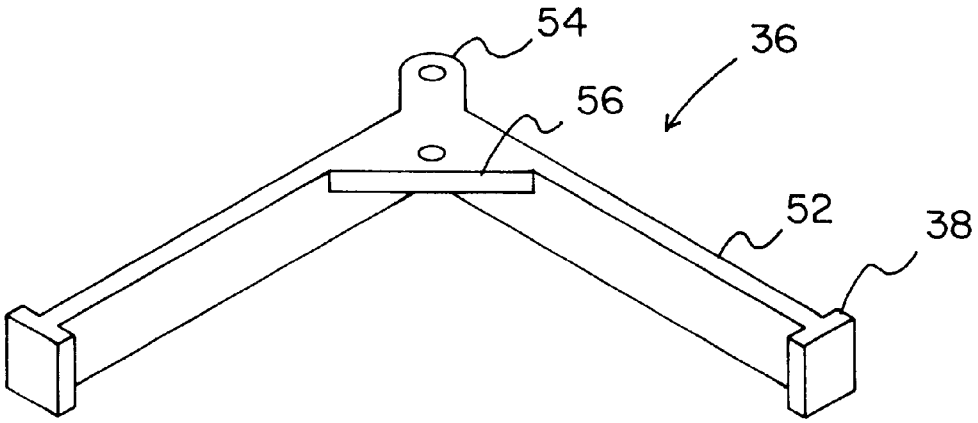
FIGS. 13–16 show various embodiments of the angled lateral interconnects of the present invention.
Figure 14:
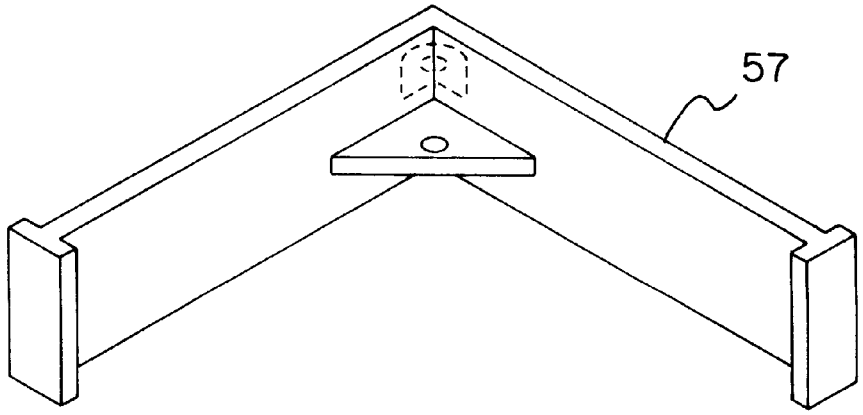
Figure 15:
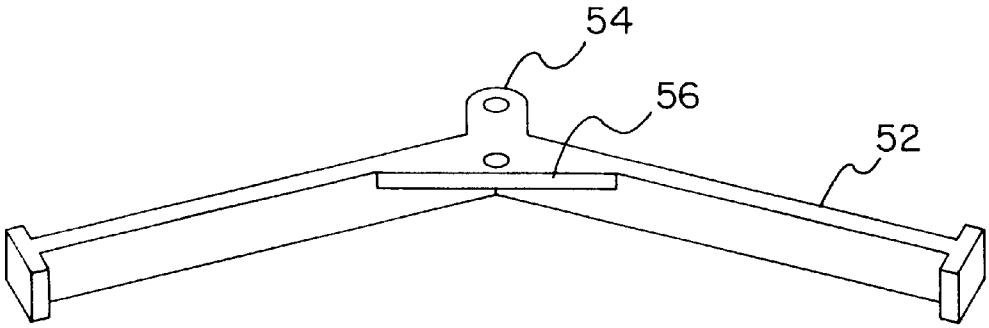
Figure 16:
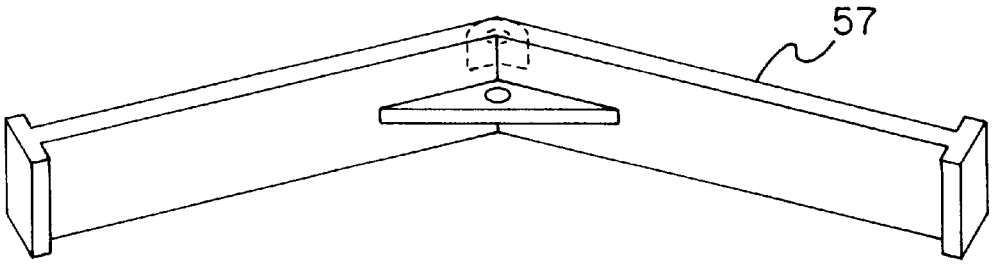

Next provided is a door assembly 20 including a square opening 21 formed in at least one of the wall sections. The square opening defines a bottom edge spacedly situated in parallel relationship with the bottom edge of the corresponding wall section. Further defined is a pair of side edges which extend to the top edge. As shown in FIG. 12, one of the side edges of the square opening has a flange 22 extending along a length thereof and in coplanar relationship with an outer surface of the corresponding wall section. In addition, a tab 24 is mounted to the side edge to which the flange is coupled in coplanar relationship with an inner surface of the corresponding wall section.

Figure 11:
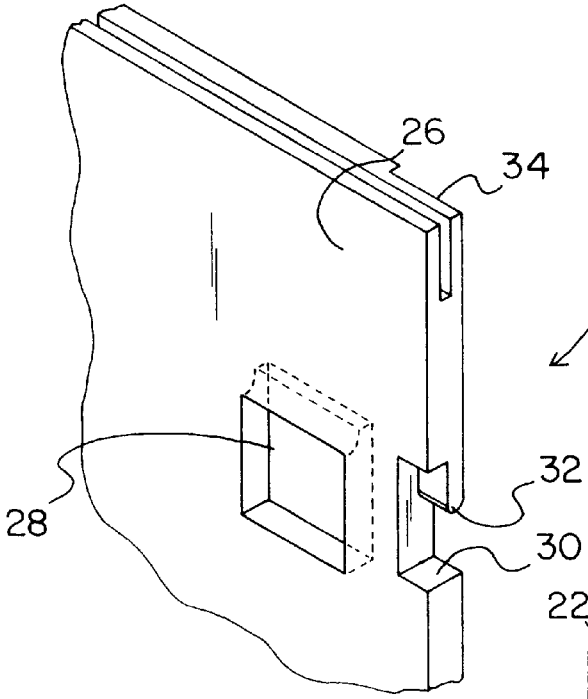
FIGS. 11 and 12 are perspective view of the door and opening of the associated wall section of the door assembly of FIG. 10.

The door assembly further includes a square planar door 26 pivotally coupled along a side edge thereof to one of the side edges of the square opening. The door assembly is further adapted to allow a slight vertical adjustment thereof. This is accomplished by an elongated post mounted within the square opening of the wall section which slidably and pivotally receives a vertical bore formed in the door. FIG. 11 depicts a recessed handle 28 formed in an inner surface of the door. A square cut out 30 is formed in one of the side edges opposite the pivotal coupling. Mounted within the square cut out is a downwardly extending member 32. A recess 34 is formed in an outer surface of the door along one of the side edges thereof.

By this structure, the door is adapted to pivot between a closed orientation wherein the flange of the corresponding wall section resides within the recess of the door and the downwardly extending member is positioned between the tab and flange of the corresponding wall section for locking purposes. The door is further adapted to have an open orientation upon the lifting and pivoting thereof.

Also included is a plurality of lateral interconnects 36 each including a plate with a pair of outwardly extending tabs 38 mounted on each end thereof. As such, the plates of the lateral interconnects may be removable mounted within the elongated slot of a pair of wall sections. In such orientation, the outwardly extending members remain within the square bores to maintain the relative orientation of the wall sections.

Figure 7:
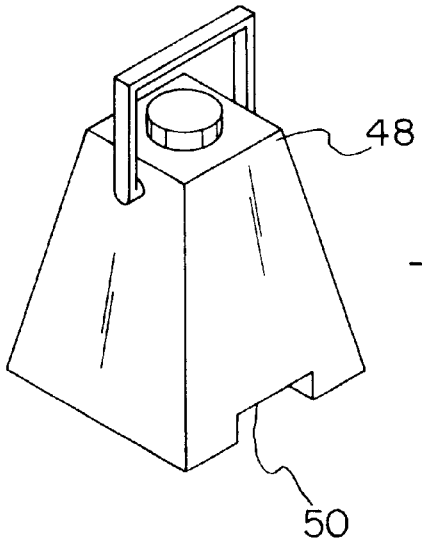
FIG. 7 is a perspective view of the anchor of the anchor assembly of the present invention.
Figure 8:
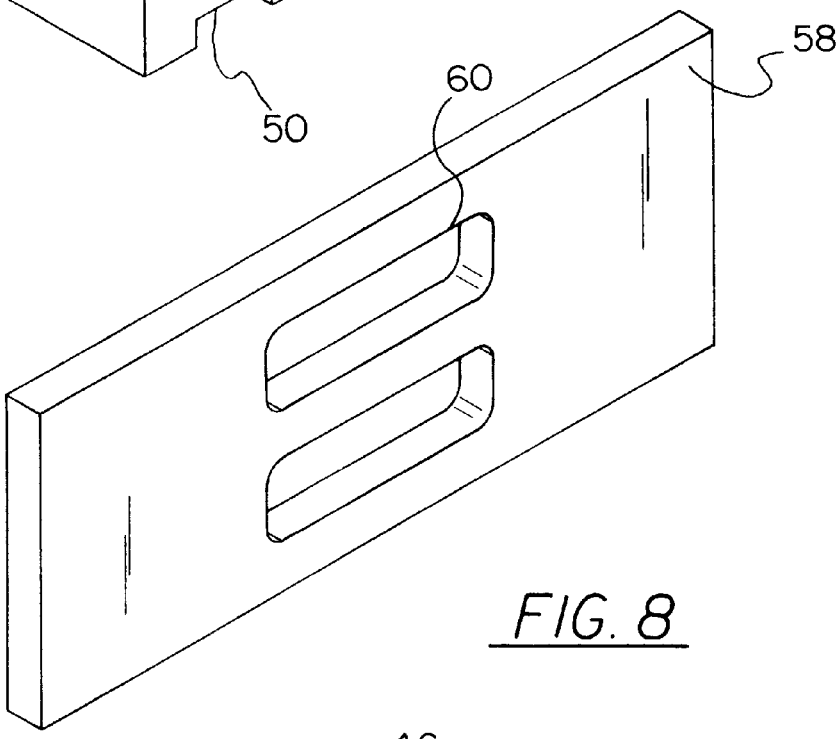
FIG. 8 is a perspective view of the longitudinal interconnect of the present invention.
Figure 9:
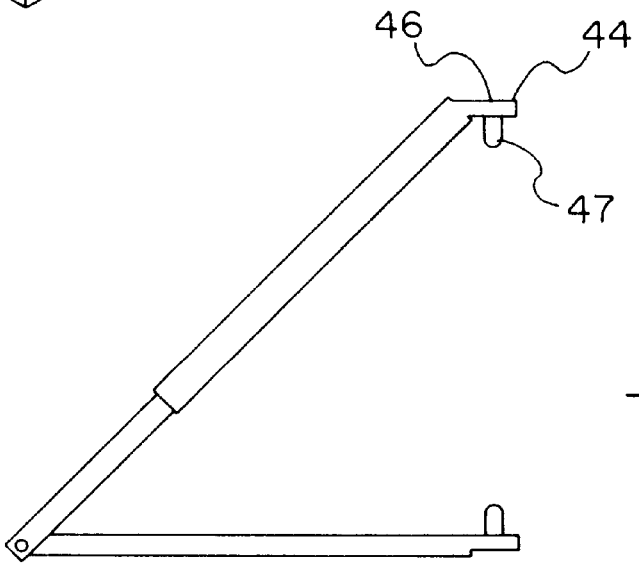
FIG. 9 is a side view of the frame of the anchor assembly.
Figure 10:
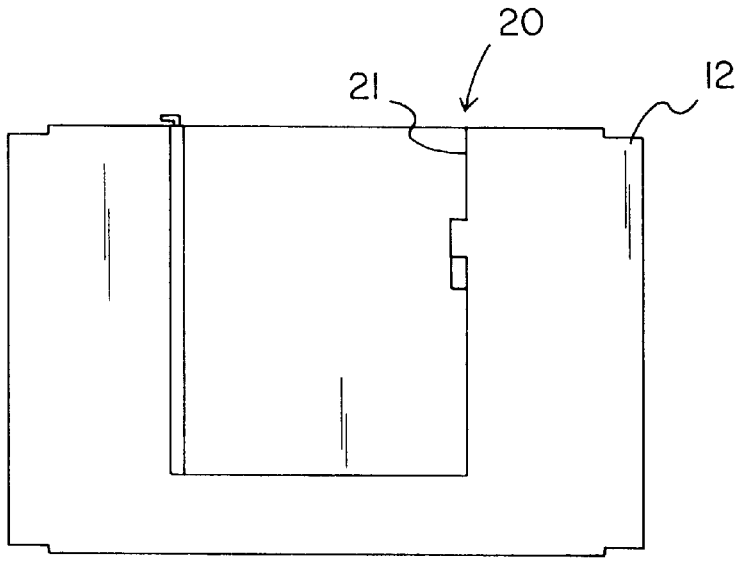
FIG. 10 is a side view of the door assembly of the present invention.

FIGS. 4–7 and 9 show an anchor assembly 40 including a pair of spherical members 42 mounted to a central extent of at least two of the lateral interconnects and extending outwardly therefrom. Note FIGS. 5 & 6. A frame 44 is provided including a horizontally oriented member with a first end and a second end. Associated therewith is a telescoping angled member with a first end and a second end. As shown in FIG. 9, the first ends of the horizontally oriented member and the angled member are hingably coupled. The second ends of the members of the frame are equipped with a recess 46 for snappily receiving the spherical members of the interconnects of the anchor assembly. The recesses are preferably formed in cups 47 shown in FIG. 9. FIG. 7 depicts a hollow anchor 48 with a lid for allowing an interior space thereof to be filled with sand. A bottom face of the anchor has a rectangular slot 50 for receiving the horizontal member of the anchor assembly. During use, the anchor maintains the frame level on a receiving surface to ensure that the wall sections remain vertically oriented.

As shown in FIGS. 13–16, the lateral interconnects include a plurality of angled interconnects 52 which are bisected by an elbow for allowing adjacent wall sections be coupled such that planes in which they reside intersect at various angles. An outer surface of the elbow of each angled interconnect has an eyelet 54 for the removable coupling of rope for support purposes. Each angled interconnect further has a gusset 56 situated in coplanar relationship with a top edge of the interconnect and the eyelet. Note FIGS. 13 & 15. It should be noted that a plurality of longitudinal angled interconnects 57 are included with structure similar to the lateral angled interconnects with the exception of the gussets and eyelet being located at a central extent thereof. Such positioning is critical so as not to interfere with the stacking and lateral situation of the wall sections.

Finally, a plurality of longitudinal interconnects 58 each include a planar plate with a pair of oblong cutouts 60 formed therein at a central extent thereof. The longitudinal interconnects are adapted to be removably inserted within slots associated with the top edge of a first wall section and the bottom edge of a second wall such that they are stacked vertically.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable structure comprising, in combination:

a plurality of wall sections each having a front face, a rear face, and a periphery formed therebetween defined by a horizontally oriented linear top and bottom edge and a pair of vertically oriented linear side edges, each top and bottom edge having an elongated slot formed therein along an entire length thereof and in communication with the side edges, a pair of rectangular cut outs formed therein at opposite ends thereof, and a pair of vertically oriented square bores each with a square horizontal cross-section, the square bores formed in the top edge adjacent to the cut outs;

a door assembly including a square opening formed in at least one of the wall sections which defines a bottom edge spacedly situated in parallel relationship with the bottom edge of the corresponding wall section and a pair of side edges which extend to the top edge, one of the side edges of the square opening having a flange extending along a length thereof and in coplanar relationship with an outer surface of the corresponding wall section and a tab mounted to the side edge to which the flange is mounted and in coplanar relationship with an inner surface of the corresponding wall section, the door assembly further including a square planar door pivotally coupled along a side edge thereof to one of the side edges of the square opening and further adapted to allow a slight vertical adjustment thereof, the door including a recessed handle formed in an inner surface thereof, a square cut out formed in one of the side edges opposite the pivotal coupling, a downwardly extending member mounted within the square cut out and a recess formed in an outer surface of the door along one of the side edges thereof, whereby the door is adapted to pivot between a closed orientation wherein the flange of the corresponding wall section resides within the recess of the door and the downwardly extending member is positioned between the tab and flange of the corresponding wall section for locking purposes and an open orientation upon the lifting and pivoting of the door;

a plurality of lateral interconnects each including a plate with a pair of outwardly extending tabs mounted on each end thereof, whereby the lateral plates of the lateral interconnects are removable mounted within the elongated slot of a pair of wall sections such that the outwardly extending members remain within the square bores to maintain the relative orientation of the wall sections;

an anchor assembly including a pair of spherical members mounted to a central extent of at least two of the lateral interconnects and extending outwardly therefrom, a frame including a horizontally oriented member with a first end and a second end, a telescoping angled member with a first end and a second end wherein the first ends of the horizontally oriented member and the angled member are hingably coupled and second ends of the members of the frame are equipped with a recess for snappily receiving the spherical members of the interconnects of the anchor assembly, the anchor assembly further including a hollow anchor with a lid for allowing an interior space thereof to be filled with sand, a bottom face of the anchor having a rectangular slot for receiving the horizontal member of the anchor assembly thereby maintaining the same level on a receiving surface to ensure that the wall sections remain vertically oriented;

said lateral interconnects further including angled interconnects which are bisected by an elbow for allowing adjacent wall sections be coupled such that planes in which they reside intersect at various angles, an outer surface of the elbow of each angled interconnect having an eyelet for the removable coupling of rope for support purposes; and a plurality of longitudinal interconnects each including a planar plate with a pair of oblong cutouts formed therein at a central extent thereof, the longitudinal interconnects adapted to be removably inserted within slots associated with the top edge of a first wall section and the bottom edge of a second wall such that they are stacked vertically.

2. A portable structure comprising:

a plurality of wall sections each having a front face, a rear face, and a periphery formed therebetween defined by a horizontally oriented linear top and bottom edge and a pair of vertically oriented linear side edges, each top edge having an elongated slot formed therein along an entire length thereof and in communication with the side edges;

a plurality of interconnects adapted to be removably situated within the slots of adjacent wall sections to maintain the lateral relationship thereof;

an anchor assembly for maintaining the wall sections in a vertical orientation, the anchor assembly having a recess for snappily receiving at least one of the interconnects;

said interconnects including planar interconnects and angled interconnects; and wherein a door assembly is included in one of the wall sections, and wherein the door is adapted to open only upon the lifting and subsequent pivoting thereof.

3. The portable structure as set forth in claim 2 wherein a pair of bores are formed in the top edge of each wall section in communication with the slot and the interconnects include outwardly extending tabs to prevent lateral movement of the wall sections.

4. The portable structure as set forth in claim 2 wherein the bottom edges of the wall sections each are equipped with a slot such that the interconnects may be employed to stack the wall sections vertically.

5. The portable structure as set forth in claim 2 wherein the anchor assembly includes a horizontal member and an angle member.

6. The portable structure as set forth in claim 2 wherein the anchor assembly is held in place by way of a removable weight.

7. The portable structure as set forth in claim 5 wherein at least one of the members of the anchor assembly is connected to one of the interconnects.

8. The portable structure as set forth in claim 7 wherein the at least one member of anchor assembly is removably connected to the interconnect.

9. The portable structure as set forth in claim 2 wherein at least one of the interconnects includes an eyelet for support purposes.

10. The portable structure as set forth in claim 2 wherein the door assembly includes a square opening formed in at least one of the wall sect-ions which defines a bottom edge spacedly situated in parallel relationship with the bottom edge of the corresponding wall section and a pair of side edges which extend to the top edge, one of the side edges of the square opening having a flange extending along a length thereof and in coplanar relationship with an outer surface of the corresponding wall section and a tab mounted to the side edge to which the flange is mounted and in coplanar relationship with an inner surface of the corresponding wall section.

11. The portable structure as set forth in claim 10 wherein the door assembly includes a square planar door pivotally coupled along a side edge thereof to one of the side edges of the square opening and further adapted to allow a slight vertical adjustment thereof, the door including a recessed handle formed in an inner surface thereof, a square cut out formed in one of the side edges opposite the pivotal coupling, a downwardly extending member mounted within the square cut out and a recess formed in an outer surface of the door along one of the side edges thereof, whereby the door is adapted to pivot between a closed orientation wherein the flange of the corresponding wall section resides within the recess of the door and the downwardly extending member is positioned between the tab and flange of the corresponding wall section for locking purposes and an open orientation upon the lifting and pivoting of the door.

12. The portable structure as set forth in claim 9 wherein the interconnects each include a plate with a pair of outwardly extending tabs mounted on each end thereof, whereby the lateral plates of the interconnects are removably mounted within the elongated slot of a pair of wall sections.

13. The portable structure as set forth in claim 12 wherein said interconnects further including angled interconnects which are bisected by an elbow for allowing adjacent wall sections be coupled such that planes in which they reside intersect at various angles.

14. The portable structure as set forth in claim 11 wherein an anchor assembly includes a pair of spherical members mounted to a central extent of at least two of the lateral interconnects and extends outwardly therefrom, a frame includes the horizontal member with a first end and a second end, the angle member with a first end and a second end wherein the first ends of the horizontal member and the angle member are hingably coupled.

15. The portable structure as set forth in claim 5 wherein the anchor assembly further includes a hollow anchor with a lid for allowing an interior space thereof to be filled with sand, a bottom face of the anchor has a rectangular slot for receiving the horizontal member of the anchor assembly thereby maintaining the same level on a receiving surface to ensure that the wall sections remain vertically oriented.

* * * * *